US007446487B2

(12) United States Patent
Ger et al.

(10) Patent No.: US 7,446,487 B2
(45) Date of Patent: Nov. 4, 2008

(54) DIMMING MODE SELECTING CIRCUIT AND DRIVING DEVICE USING THE SAME

(75) Inventors: Chih-Chan Ger, Shenzhen (CN); Ko-Wen Wang, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 95 days.

(21) Appl. No.: 11/309,867

(22) Filed: Oct. 16, 2006

(65) Prior Publication Data

US 2007/0188110 A1 Aug. 16, 2007

(51) Int. Cl.
*G05F 1/00* (2006.01)

(52) U.S. Cl. ..... 315/308; 315/291; 315/307; 315/224; 315/247

(58) Field of Classification Search ..... 315/326, 315/DIG. 4, 291, 297, 307–311, 224, 225, 315/209 R, 247, 246, 274–289
See application file for complete search history.

(56) References Cited

U.S. PATENT DOCUMENTS 4,141,002 A * 2/1979 Reinhold ..... 345/36
5,055,742 A 10/1991 Jurell et al.
6,304,088 B1 * 10/2001 Yee ..... 324/433
6,954,038 B2 * 10/2005 Ido et al. ..... 315/291
7,265,681 B2 * 9/2007 Chen ..... 340/815.45
7,294,975 B2 * 11/2007 Chou et al. ..... 315/291
7,307,614 B2 * 12/2007 Vinn ..... 345/102
7,315,138 B2 * 1/2008 Usami et al. ..... 315/291
2007/0103093 A1 * 5/2007 Hagen et al. ..... 315/291

FOREIGN PATENT DOCUMENTS

TW 508979 11/2002

* cited by examiner

*Primary Examiner*—Tuyet Vo
(74) *Attorney, Agent, or Firm*—Wei Te Chung

(57) ABSTRACT

A dimming mode selecting circuit (25) includes a switch circuit (251) and a compensation circuit (252). The switch circuit selects a first input voltage or a second input voltage according to an input signal. The compensation circuit connects to the switch circuit, for compensating voltage loss of the first input voltage or the second input voltage in the dimming mode selecting circuit, and outputting a first compensated input voltage or a second compensated input voltage according to the switch circuit. In the invention, the dimming mode selecting circuit combines a hysteresis circuit (250) with the compensation circuit, to make the input signal stably and the output signal reliably. The structure of the circuit is simple.

20 Claims, 5 Drawing Sheets

DIMMING MODE SELECTING CIRCUIT AND DRIVING DEVICE USING THE SAME

FIELD OF THE INVENTION

The present invention relates to electronic driving devices, and particularly to a device with a dimming mode selecting circuit for driving a light source module.

DESCRIPTION OF RELATED ART

Generally, discharge lamps are used as light sources of liquid crystal display (LCD) panels. With the increasing demand for better performance of an LCD panel, and particularly to a performance of adjusting brightness, dimming control functions for the light sources are developed. Normally, backlights not only are controlled by an internal dimming mode but also an external dimming mode. In the internal dimming mode, brightness of the LCD panel is adjusted according to predetermined values in a certain range, and in the external dimming mode, brightness of the LCD panel is adjusted according to requirements of users.

FIG. 5 is a circuit diagram of a conventional dimming mode selecting circuit. The conventional dimming mode selecting circuit includes a voltage source Vcc, a first input voltage terminal VA, a second input voltage terminal VB, a plurality of resistors R11, R22, R33, R44, R55, R66, R77, a plurality of transistors Q11, Q22, Q33, and a plurality of diodes D11, D22, D33, D44.

When an input signal Vin is a logic high level and is greater than the voltage source Vcc divided on the resistors R44 and R22, the diode D11 is off, and the transistors Q22 and Q33 are on, and the transistor Q11 is off. Therefore, the first input voltage terminal VA outputs signals via the diode D33. Similarly, when the input signal Vin is a logic low level and is less than the voltage source Vcc divided on the resistor R44 and R22, the diode D11 is on, and the transistors Q22 and Q33 are off, and the transistor Q11 is on. Therefore, the second input voltage terminal VB outputs signals via the diode D44.

The conventional dimming mode selecting circuit has a complex circuit structure with many components. In addition, the first input voltage terminal VA or the second input voltage terminal VB output signals via the diodes D33 or D44, so that voltage loss on the diodes D33 or D44 can deteriorate dimming precision of a light source module. Furthermore, the input signal Vin is easily affected by noise so that output voltage is switched back and forth between terminals VA and VB causing unstable dimming modes.

SUMMARY OF INVENTION

A dimming mode selecting circuit includes a switch circuit and a compensation circuit. The switch circuit selects a first input voltage or a second input voltage according to an input signal. The compensation circuit is connected to the switch circuit, for compensating voltage loss of the first input voltage or the second input voltage in the dimming mode selecting circuit, and outputting a first compensated input voltage or a second compensated input voltage according to the switch circuit.

The dimming mode selecting circuit further includes a hysteresis circuit that is connected to the switch circuit, for converting the received input signal to a stable signal, and outputting the stable signal to the switch circuit.

A driving device for driving a light source module includes a converter circuit, a driving switch circuit, a transformer circuit, a PWM controller, and a dimming mode selecting circuit. The converter circuit converts a received signal to a direct current signal. The driving switch circuit is connected to the converter circuit, for converting the direct current signal to an alternating current signal. The transformer circuit is connected between the driving switch circuit and the light source module, for converting the alternating current signal to an appropriate signal. The PWM controller is connected to the driving switch circuit, for controlling the alternating current signal output from the driving switch circuit. The dimming mode selecting circuit is connected to the PWM controller, and includes a switch circuit and a compensation circuit. The switch circuit selects a first input voltage or a second input voltage according to the input signal. The compensation circuit is connected to the switch circuit, for compensating voltage loss of the first input voltage or the second input voltage in the dimming mode selecting circuit, and outputting a first compensated input voltage or a second compensated input voltage according to the switch circuit.

Other advantages and novel features will become more apparent from the following detailed description when taken in conjunction with the accompanying drawings, in which:

DETAILED DESCRIPTION

Figure 1:
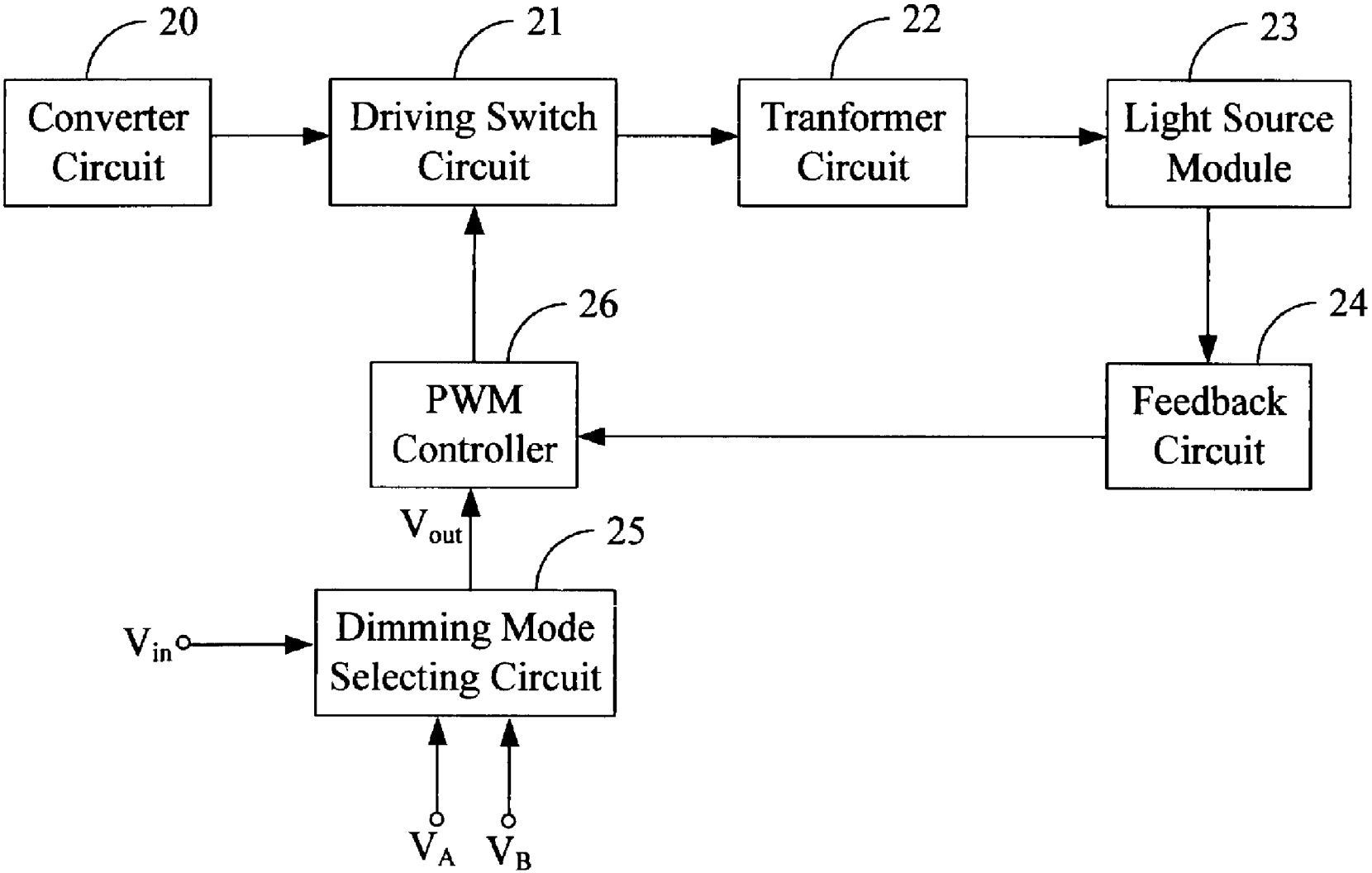
FIG. 1 is a block diagram of a driving device of an exemplary embodiment of the present invention.

FIG. 1 is a block diagram of a driving device of an exemplary embodiment of the present invention. The driving device for driving a light source module 23 includes a converter circuit 20, a driving switch circuit 21, a transformer circuit 22, a feedback circuit 24, a dimming mode selecting circuit 25, and a PWM controller 26. The light source module 23 includes a plurality of lamps.

The converter circuit 20 converts a received signal to a direct current (DC) signal. The driving switch circuit 21 is connected to the converter circuit 20, and converts the DC signal to an alternating current (AC) signal. The transformer circuit 22 is connected between the driving switch circuit 21 and the light source module 23, and converts the AC signal to an appropriate signal to drive the light source module 23. In the exemplary embodiment, the AC signal output from the driving switch circuit 21 is a rectangular-wave signal, and the appropriate signal output from the transformer circuit 22 is a sine-wave signal. The feedback circuit 24 is connected between the light source module 23 and the PWM controller 26, for feeding back current flowing through the light source module 23 to the PWM controller 26. The PWM controller 26 is connected to the driving switch circuit 21, for controlling the AC signal output from the driving switch circuit 21.

The dimming mode selecting circuit 25 is connected to the PWM controller 26, for selecting a first input voltage or a second input voltage according to an input control signal Vin, and outputting a selected input voltage to the PWM controller 26. The PWM controller 26 provides a control signal to the driving switch circuit 21, to control the AC signal output from the driving switch circuit 21, according to signals output from the feedback circuit 24 and the dimming mode selecting circuit 25. Therefore, the PWM controller 26 controls the current flowing through the light source module 23, and adjusts the brightness of the light source module 23.

In the exemplary embodiment, the input signal Vin is an unstable logic high level or an unstable logic low level signal. The logic high level ranges from 2V to 5V, and the logic low level ranges from 0V to 0.8V. The first input voltage and the second input voltage indicate two different dimming modes. The first input voltage indicates an external dimming mode, the second input voltage indicates an internal dimming mode.

Figure 2:
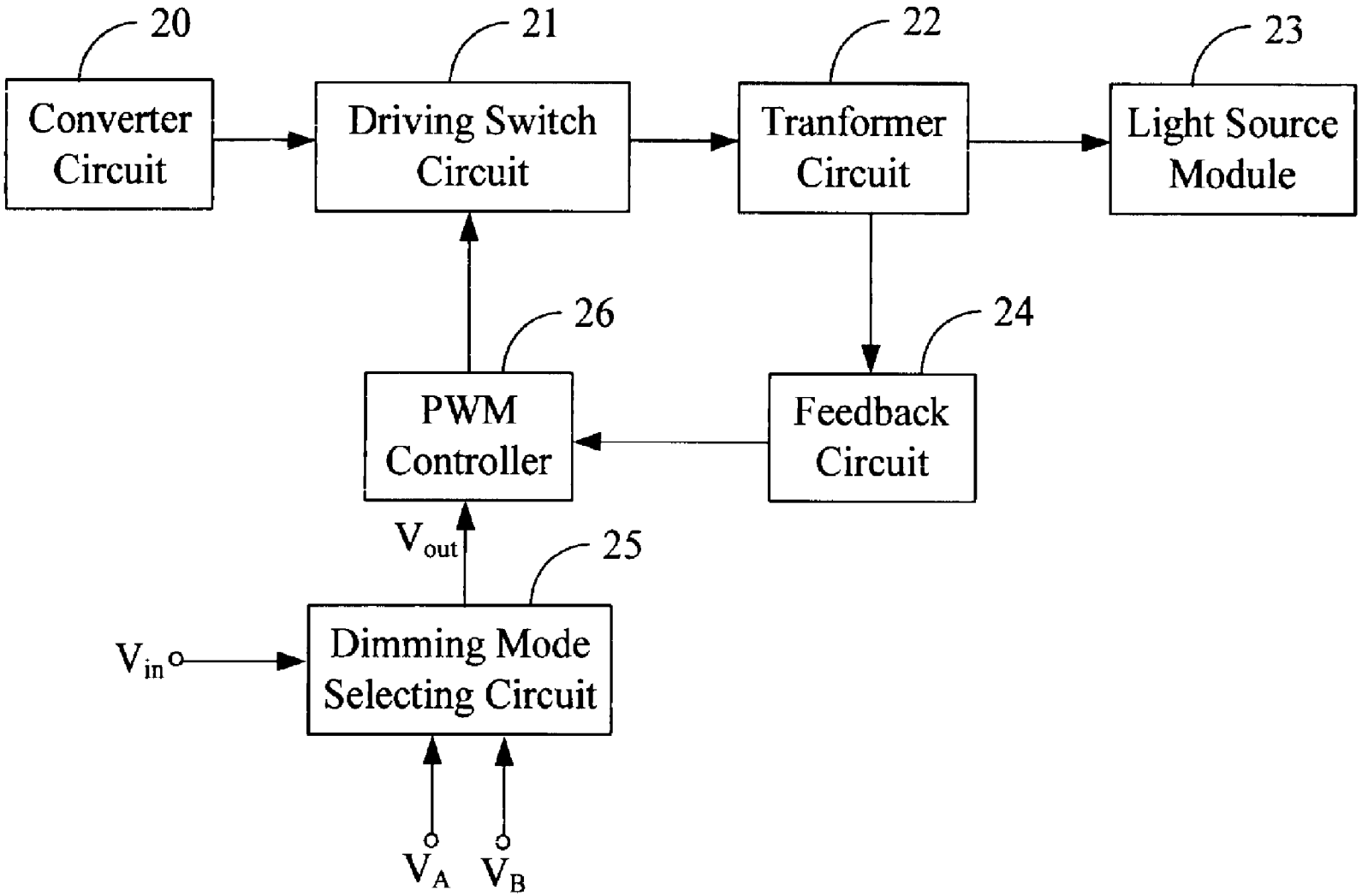
FIG. 2 is a block diagram of a driving device of another exemplary embodiment of the present invention.

FIG. 2 is a block diagram of a driving device of another exemplary embodiment of the present invention. The driving device as shown in FIG. 2 is substantially the same as that of in FIG. 1, except that the feedback circuit 24 is connected between the transformer circuit 22 and the PWM controller 26, also for feeding back current flowing through the light source module 23 to the PWM controller 26.

Figure 3:
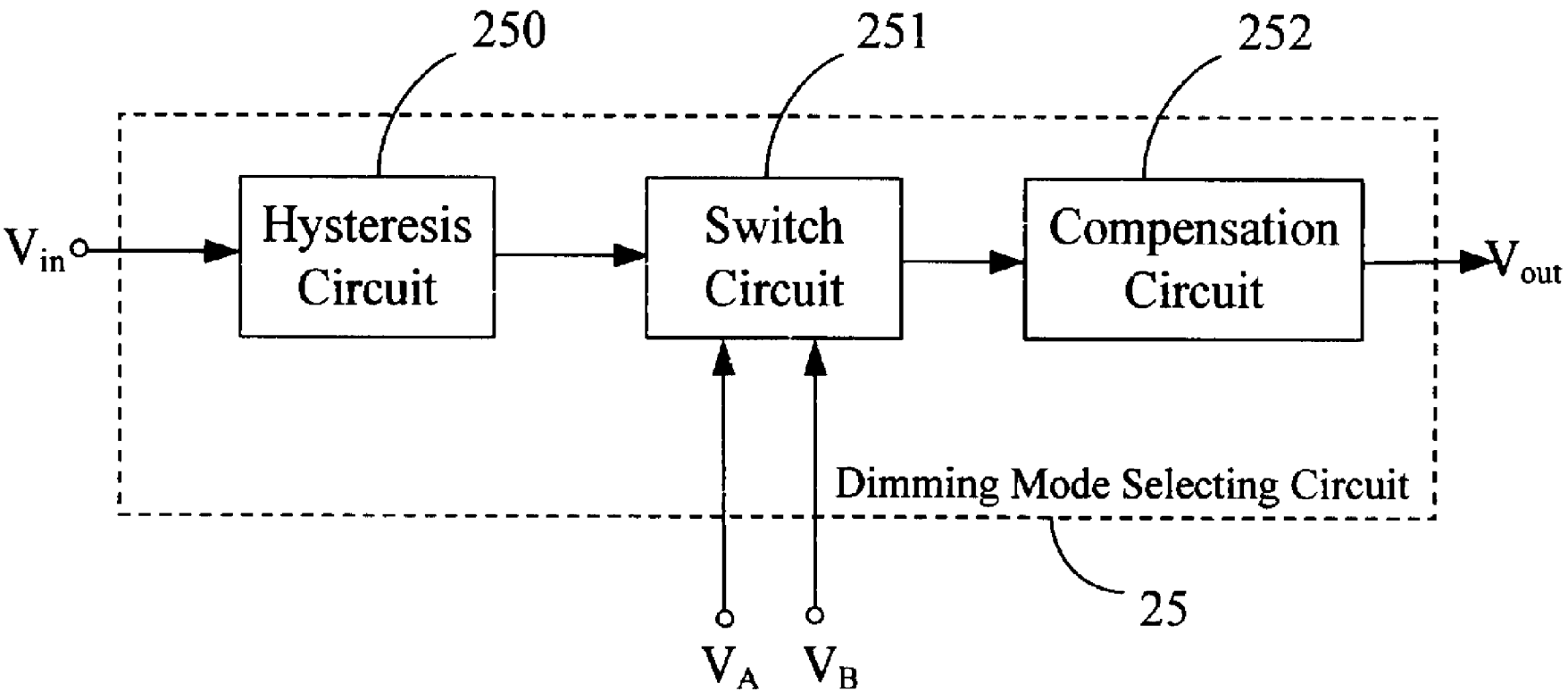
FIG. 3 is a block diagram of a dimming mode selecting circuit of FIG. 1 and FIG. 2.

FIG. 3 is a block diagram of a dimming mode selecting circuit 25 of the driving device of FIG. 1 and FIG. 2. The dimming mode selecting circuit 25 includes a hysteresis circuit 250, a switch circuit 251, and a compensation circuit 252.

The hysteresis circuit 250 converts the received input signal Vin to a stable logic low level or a stable logic high level signal. The switch circuit 251 is connected to the hysteresis circuit 250, for selecting the first input voltage or the second input voltage according to the stable signal output from the hysteresis circuit 250. That is, the switch circuit 251 selects the external dimming mode or the internal dimming mode according to the stable signal. The compensation circuit 252 is connected to the switch circuit 251, for compensating voltage loss of the first input voltage or the second input voltage in the dimming mode selecting circuit 25.

In the exemplary embodiment, the voltage loss compensated by the compensation circuit 252 includes the voltage loss on electronic components when current flows therethrough, and the voltage loss on electronic components from external temperature change.

Figure 4:
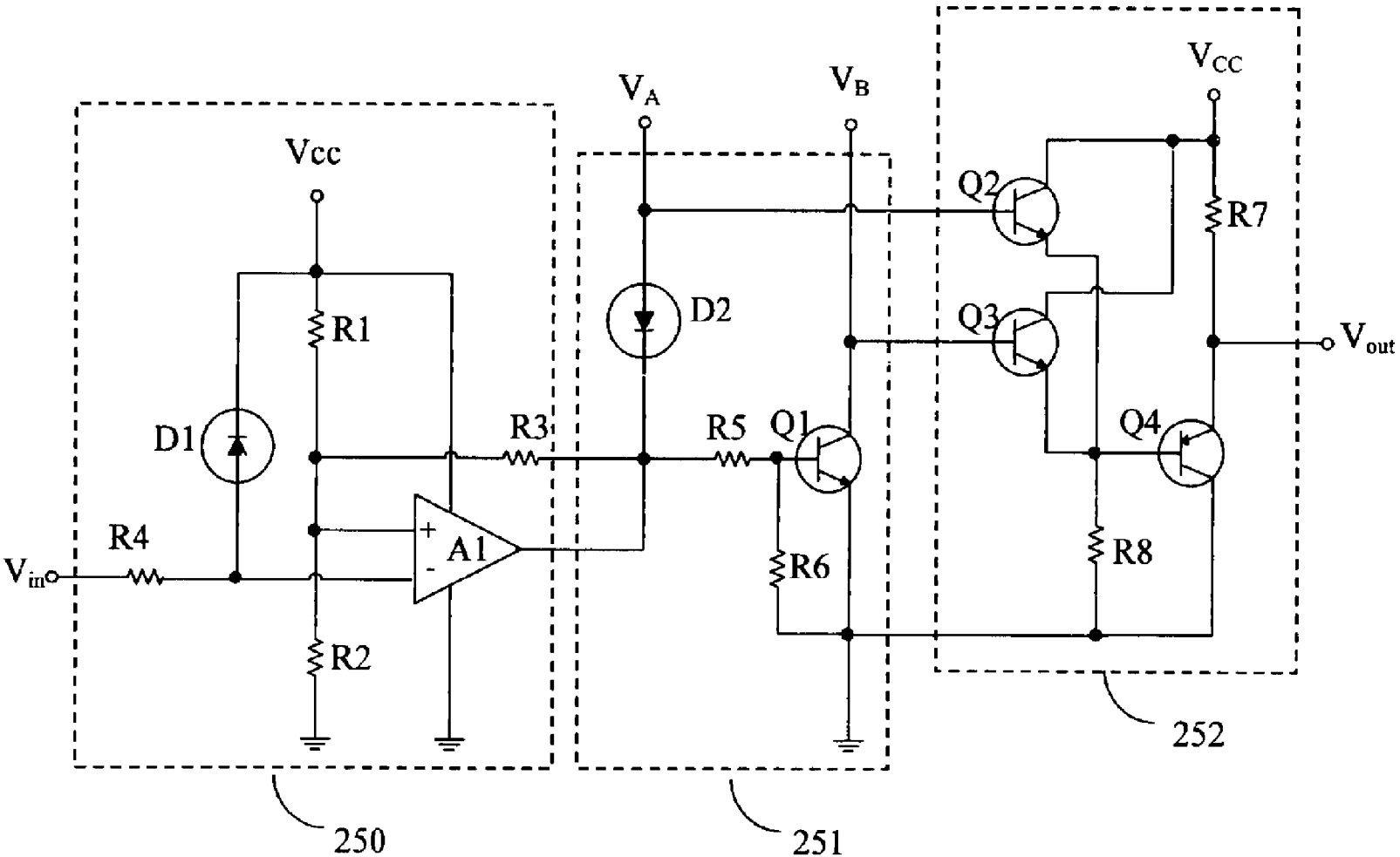
FIG. 4 is a detailed exemplary circuit diagram of the dimming mode selecting circuit of FIG. 3.
Figure 5:
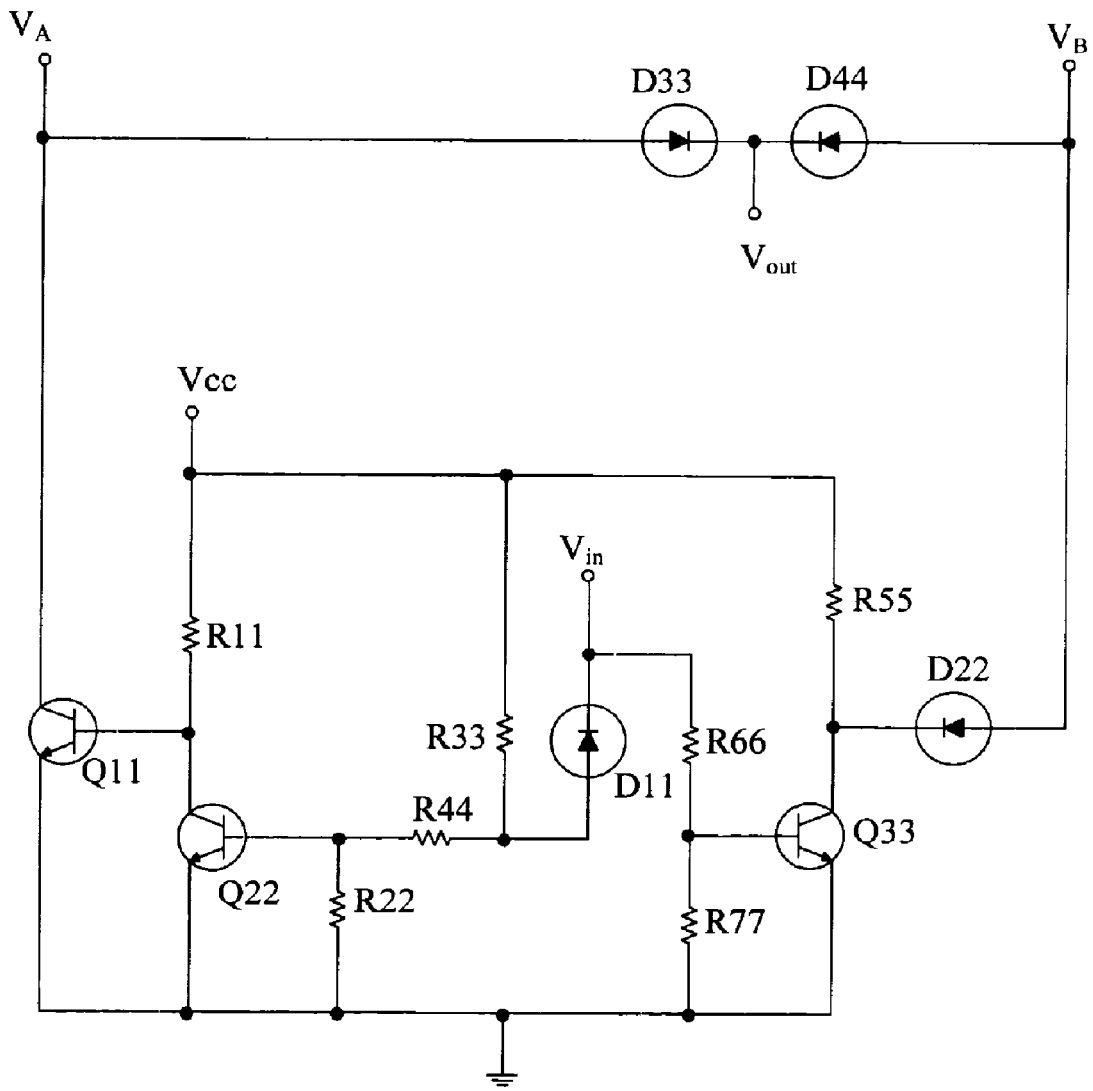
FIG. 5 (Related Art)
FIG. 5 is a circuit diagram of a conventional dimming mode selecting circuit.

FIG. 4 is a detailed exemplary circuit diagram of the dimming mode selecting circuit 25 of FIG. 3 of the invention. The hysteresis circuit 250 includes a voltage source Vcc, an over-voltage protecting diode D1, a comparator A1, a first resistor R1, a second resistor R2, a third resistor R3, and a fourth resistor R4. The comparator A1 has a first pin, a second pin, a third pin, a fourth pin, and a fifth pin.

The first resistor R1 is connected between the voltage source Vcc and the first pin of the comparator A1. The second resistor R2 is connected between the first pin of the comparator A1 and the ground. In the exemplary embodiment, the fourth resistor R4 is a voltage divider resistor. One end of the fourth resistor R4 is defined as an input of the hysteresis circuit 250 for receiving the input signal Vin. The other end of the fourth resistor R4 is connected to the second pin of the comparator A1, for protecting the comparator A1 from an over voltage signal. The third pin of the comparator A1 is connected to the voltage source Vcc, and the fourth pin of the comparator A1 is grounded. The third resistor R3 is connected between the first pin and the fifth pin of the comparator A1, and the fifth pin of the comparator A1 is defined as an output of the hysteresis circuit 250. The over-voltage protecting diode D1 has an anode and a cathode. The anode of the over-voltage protecting diode D1 is connected to the second pin of the comparator A1. The cathode of the over-voltage protecting diode D1 is connected to the voltage source Vcc, for also protecting the comparator A1 from an over voltage signal.

In the exemplary embodiment, the first resistor R1 and the second resistor R2 form a divider circuit for dividing the voltage source Vcc and outputting the divided voltage to the first pin of the comparator A1. A first threshold voltage and a second threshold voltage are predetermined by the first resistor R1, the second resistor R2, the third resistor R3, the voltage source Vcc, and the comparator A1. The first threshold voltage is a high threshold voltage, and the second threshold voltage is a low threshold voltage. A difference between the first threshold voltage and the second threshold voltage is a hysteresis voltage.

When the input signal Vin changes from a logic low level to a logic high level, and if the input signal Vin is less than the first threshold voltage, the comparator A1 outputs a logic high level. Contrarily, if the input signal Vin is greater than the first threshold voltage, the comparator A1 outputs a logic low level. Even if the input signal Vin continues to increase, the comparator A1 still outputs the logic low level.

When the input signal Vin changes from a logic high level to a logic low level, and the input signal Vin is greater than the second threshold voltage, the comparator A1 outputs a logic low level. Contrarily, if the input signal Vin is less than the second threshold voltage, the comparator A1 outputs a logic high level. Even if the input signal Vin continues to decrease, the comparator A1 still outputs the logic high level.

Therefore, even if the input signal Vin varies, so long as it varies in a range of the hysteresis voltage, output of the comparator A1 will be stable, and consequently, the hysteresis circuit 250 outputs a stable logic high level or logic low level signal to the switch circuit 251.

The switch circuit 251 includes an isolating diode D2, an NPN transistor Q1, a fifth resistor R5, and a sixth resistor R6. The isolating diode D2 has an anode and a cathode. The anode of the isolating diode D2 is connected to a first input voltage terminal VA. The cathode of the isolating diode D2 is connected to the output of the hysteresis circuit 250, for avoiding current flowing back to the hysteresis circuit 250. The firth resistor R5, the sixth resistor R6 and the NPN transistor Q1 form a digital transistor having an input, a first output, and a second output. One end of the fifth resistor R5 is defined as the input of the digital transistor, which is connected to the output of the comparator A1, and the other end of the fifth resistor R5 is connected to a base of the NPN transistor Q1. A collector of the NPN transistor Q1 is defined as the first output of the digital transistor, which is connected to a second input voltage terminal VB. An emitter of the NPN transistor Q1 is grounded, which is defined as the second output of the digital transistor. The sixth resistor R6 is connected between the base and the emitter of the NPN transistor Q1. In the exemplary embodiment, the digital transistor has a high input impedance and a low output impedance, thereby not only reducing influence to a front-end circuit, but also increasing driving ability of a back-end circuit.

In the exemplary embodiment, when the switch circuit 251 receives a logic high level output signal from the hysteresis circuit 250, the diode D2 is turned off, and the NPN transistor Q1 is turned on. Then, the second input voltage terminal VB is grounded via the NPN transistor Q1, and provides an appropriate voltage to the NPN transistor Q1 to ensure the NPN transistor Q1 works normally. Therefore, the first input voltage is output to the compensation circuit 252. Contrarily, when the switch circuit 251 receives a logic low level output signal from the hysteresis circuit 250, for example, the hysteresis circuit 250 outputs 0V, the diode D2 is turned on, and the NPN transistor Q1 is turned off. Since the first input voltage terminal terminal VA is connected to the output of the comparator A1 via the diode D2, the second input voltage is output to the compensation circuit 252.

The compensation circuit 252 includes a voltage source Vcc, a seventh resistor R7, a current limiting resistor R8, two NPN transistors Q2, Q3, and a PNP transistor Q4. An emitter of the PNP transistor Q4 is defined as an output of the compensation circuit 252. A base of the NPN transistor Q2 is connected to the first input voltage terminal VA. An emitter of the NPN transistor Q2 is connected to a base of the PNP transistor Q4. A collector of the NPN transistor Q2 is connected to the voltage source Vcc. A base of the NPN transistor Q3 is connected to the second input voltage terminal VB. An emitter of the NPN transistor Q3 is connected to the base of the PNP transistor Q4. A collector of the NPN transistor Q3 is connected to the collector of the NPN transistor Q2. The seventh resistor R7 is connected between the voltage source Vcc and the emitter of the PNP transistor Q4, for protecting the output of the compensation circuit 252. The current limiting resistor R8 is connected between the base and a collector of the PNP transistor Q4, for protecting the PNP transistor Q4.

In the exemplary embodiment, the first input voltage is output to the PWM controller 26 via the NPN transistor Q2 and the PNP transistor Q4. However, there is about 0.7V of voltage loss between the base and the emitter of the NPN transistor Q2. For example, when the first input voltage is 5V, voltage of the emitter of the NPN transistor Q2 is 4.3V. Because the NPN transistor Q2 and the PNP transistor Q4 are a complementary pair of transistors with a voltage difference between the base and the emitter of the PNP transistor Q4 of −0.7V, voltage output from the first input voltage via the NPN transistor Q2 and the PNP transistor Q4 is also 5V, that is, the first input voltage is output without any loss.

Similarly, the second input voltage is output to the PWM controller 26 via the NPN transistor Q3 and the PNP transistor Q4. However, there is also about 0.7V voltage loss between the base and the emitter of the NPN transistor Q3. Because the NPN transistor Q3 and the PNP transistor Q4 are also a complementary pair of transistors, the PNP transistor Q4 is used for compensating voltage loss of the second input voltage on the NPN transistor Q3. Therefore, voltage output from the second input voltage via the NPN transistor Q3 and the PNP transistor Q4 is not changed, that is, the second input voltage is output without any loss.

In addition, due to external temperature variation, the transistor is easily affected, particularly voltage difference between the base and the emitter of the transistor. In the exemplary embodiment, the NPN transistor Q2 and the PNP transistor Q4, or the NPN transistor Q3 and the PNP transistor Q4 form a complementary circuit. When the external temperature varies, the voltage difference between the base and the emitter of the PNP transistor Q4 vary accordingly. Therefore, the PNP transistor Q4 compensates voltage loss on the NPN transistors Q2 or Q3 caused by the external temperature change such that the driving device is not affected. In the exemplary embodiment, output signal Vout of the dimming mode selecting circuit 250 is the selected first input voltage or the selected second input voltage.

In the exemplary embodiment, when the input signal Vin is an unstable logic low level signal, the hysteresis circuit 250 outputs a stable logic high level signal to the switch circuit 251 to turn on the NPN transistor Q1. Therefore, the first input voltage is output to the PWM controller 26 via the NPN transistor Q2 and the PNP transistor Q4. That is, the driving device selects the external dimming mode. Contrarily, when the input signal Vin is an unstable logic high level signal, the hysteresis circuit 250 outputs a stable logic low level signal to the switch circuit 251 to turn off the NPN transistor Q1. Therefore, the second input voltage is output to the PWM controller 26 via the NPN transistor Q3 and the PNP transistor Q4. That is, the driving device selects the internal dimming mode.

While various embodiments and methods of the present invention have been described above, it should be understood that they have been presented by way of example only and not by way of limitation. Thus the breadth and scope of the present invention should not be limited by the above-described exemplary embodiments, but should be defined only in accordance with the following claims and their equivalent.

What is claimed is:

1. A dimming mode selecting circuit, comprising:

a switch circuit for selecting a first input voltage or a second input voltage according to an input signal; and a compensation circuit, connected to the switch circuit, for compensating voltage loss of the first input voltage or the second input voltage in the dimming mode selecting circuit, and outputting a first compensated input voltage or a second compensated input voltage according to the switch circuit;

wherein the voltage loss includes voltage loss on electronic components when current flows therethrough, and voltage loss on electronic components from external temperature change.

2. The dimming mode selecting circuit as claimed in claim 1, wherein the compensation circuit comprises:

a voltage source;

a PNP transistor having an emitter being defined as an output of the compensation circuit;

a second NPN transistor having a base connected to the first input voltage terminal, an emitter connected to the base of the PNP transistor, and a collector connected to the voltage source;

a third NPN transistor having a base connected to the second input voltage terminal, an emitter connected to the base of the PNP transistor, and a collector connected to the collector of the second NPN transistor;

a seventh resistor, connected between the voltage source and the emitter of the PNP transistor, for protecting the output of the compensation circuit; and a current limiting resistor, connected between the base and the collector of the PNP transistor, for protecting the PNP transistor.

3. The dimming mode selecting circuit as claimed in claim 1, further comprising a hysteresis circuit connected to the switch circuit, for converting the input signal to a stable signal, and outputting the stable signal to the switch circuit.

4. The dimming mode selecting circuit as claimed in claim 3, wherein the hysteresis circuit comprises:

a voltage source;

a comparator having a first pin, a second pin, a third pin, a fourth pin, and a fifth pin; wherein the second pin receives the input signal, the third pin is connected to the voltage source, the fourth pin is grounded, and the fifth pin is defined as an output of the hysteresis circuit;

a first resistor, connected between the voltage source and the first pin of the comparator;

a second resistor, connected between the first pin of the comparator and the ground; and a third resistor, connected between the first pin of the comparator and the fifth pin of the comparator.

5. The dimming mode selecting circuit as claimed in claim 2, wherein the hysteresis circuit further comprises an over-voltage protecting diode having an anode and a cathode; wherein the anode of the over-voltage protecting diode is connected to the second pin of the comparator, and the cathode of the over-voltage protecting diode is connected to the voltage source, for protecting the comparator from an over voltage signal.

6. The dimming mode selecting circuit as claimed in claim 2, wherein the hysteresis circuit further comprises a voltage divider resistor, wherein one end of the voltage divider resistor is defined as an input of the hysteresis circuit for receiving the input signal, and the other end of the voltage divider resistor is connected to the second pin of the comparator, for protecting the comparator from receiving an over voltage signal.

7. The dimming mode selecting circuit as claimed in claim 2, wherein the switch circuit comprises:

an isolating diode having an anode and a cathode, wherein the anode of the isolating diode is connected to a first input voltage terminal, the cathode of the isolating diode is connected to the output of the hysteresis circuit for avoiding current flowing back to the hysteresis circuit; and a digital transistor comprising an input a first output, and a second output, wherein the input of the digital transistor is connected to the output of the hysteresis circuit, the first output of the digital transistor is connected to a second input voltage terminal, and the second output of the digital transistor is grounded.

8. The dimming mode selecting circuit as claimed in claim 7, wherein the digital transistor comprises:

a fifth resistor having one end being defined as the input of the digital transistor;

a first NPN transistor, having a base connected to the other end of the fifth resistor, a collector being defined as the first output of the digital transistor, and an emitter being defined as the second output of the digital transistor; and a sixth resistor, connected between the base and the emitter of the NPN transistor.

9. A driving device for driving a light source module, comprising:

a converter circuit, for converting a received signal to a direct current signal;

a driving switch circuit, connected to the convener circuit, for converting the direct current signal to an alternating current signal;

a transformer circuit, connected between the driving switch circuit and the light source module, for converting the alternating current signal to an appropriate signal;

a PWM controller, connected to the driving switch circuit, for controlling the alternating current signal output from the driving switch circuit; and a dimming mode selecting circuit, connected to the PWM controller, comprising:

a switch circuit, for selecting a first input voltage or a second input voltage according to an input signal; and a compensation circuit, connected to the switch circuit, for compensating voltage loss of the first input voltage or the second input voltage in the dimming mode selecting circuit, and outputting a first compensated input voltage or a second compensated input voltage according to the switch circuit;

wherein the voltage loss includes voltage loss on electronic components when current flows therethrough, and voltage loss on electronic components from external temperature change.

10. The driving device as claimed in claim 9, wherein the compensation circuit comprises:

a voltage source;

a PNP transistor having an emitter being an output of the compensation circuit;

a second NPN transistor having a base connected to the first input voltage terminal, an emitter connected to the base of the PNP transistor, and a collector connected to the voltage source;

a third NPN transistor having a base connected to the second input voltage terminal, an emitter connected to the base of the PNIP transistor, and a collector connected to the collector of the second NPN transistor;

a seventh resistor, connected between the voltage source and the emitter of the PNP transistor, for protecting the output of the compensation circuit; and a current limiting resistor, connected between the base and the collector of the PNP transistor, for protecting the PNP transistor.

11. The driving device as claimed in claim 9, further comprising a feedback circuit, connected between the light source module and the PWM controller, for feeding back current flowing through the light source module to the PWM controller.

12. The driving device as claimed in claim 9, further comprising a feedback circuit, connected between the transformer circuit and the PWM controller, for feeding back current flowing through the light source module to the PWM controller.

13. The driving device as claimed in claim 9, wherein the dimming mode selecting circuit further comprises a hysteresis circuit connected to the switch circuit for converting the received input signal to a stable signal, and outputting the stable signal to the switch circuit.

14. The driving device as claimed in claim 13, wherein the hysteresis circuit comprises:

a voltage source;

a comparator having a first pin, a second pin, a third pin, a fourth pin, and a fifth pin; wherein the second pin receives the input signal, the third pin is connected to the voltage source, the fourth pin is grounded, and the fifth pin is defined as an output of the hysteresis circuit;

a first resistor, connected between the voltage source and the first pin of the comparator;

a second resistor, connected between the first phi of the comparator and the ground; and a third resistor, connected between the first pin of the comparator and the fifth pin of the comparator.

15. The driving device as claimed in claim 14, wherein the hysteresis circuit further comprises an over-voltage protecting diode having an anode and a cathode; wherein the anode of the over-voltage protecting diode is connected to the second pin of the comparator, and the cathode of the over-voltage protecting diode is connected to the voltage source, for protecting the comparator from receiving an over voltage signal.

16. The driving device as claimed in claim 14, wherein the hysteresis circuit further comprises a voltage divider resistor, wherein one end of the voltage divider resistor is defined as an input of the hysteresis circuit for receiving the input signal, and the other end of the voltage divider resistor is connected to the second pin of the comparator, for protecting the comparator from receiving an over voltage signal.

17. The driving device as claimed in claim 14, wherein the switch circuit comprises:

an isolating diode having an anode and a cathode, wherein the anode of the isolating diode is connected to a first input voltage terminal, the cathode of the isolating diode is connected to the output of the hysteresis circuit, for avoiding current flowing back to the hysteresis circuit; and a digital transistor comprising an input, a first output, and a second output, wherein the input of the digital transistor is connected to the output of the hysteresis circuit, the first output of the digital transistor is connected to a second input voltage terminal, and the second output of the digital transistor is grounded.

18. The driving device as claimed in claim 17, wherein the digital transistor comprises:

a fifth resistor having one end being defined as the input of the digital transistor;

a first NPN transistor, having a base connected to the other end of the fifth resistor, a collector being defined as the first output of the digital transistor, and an emitter being defined as the second output of the digital transistor; and a sixth resistor, connected between the base and the emitter of the NPN transistor.

19. A circuit assembly comprising:

a first power source providing a first input voltage;

a second power source providing a second input voltage; and a selecting circuit electrically connectable between said first and second power sources, and an output of said selecting circuit, said selecting circuit selectively outputting one of said first and second input voltages in response to a control signal input to said selecting circuit, and said selecting circuit comprising a compensation circuit to compensate voltage loss of said selectively output one of said first and second input voltages when said selectively output one of said first and second input voltages is selected and passes through said selecting circuit toward said output, wherein said voltage loss includes voltage loss on electronic components when current flows therethrough, and voltage loss on electronic components from external temperature change,

20. The circuit assembly as claimed in claim 19, wherein said selecting circuit further comprises a hysteresis circuit to stabilize said control signal input to said selecting circuit.

* * * * *